US005867450A

United States Patent [19]

Rogers et al.

[11] Patent Number: 5,867,450

[45] Date of Patent: Feb. 2, 1999

[54] STATE SWITCHED ACOUSTIC TRANSDUCER

[75] Inventors: Peter H. Rogers, Atlanta; Gregg D. Larson, Athens, both of Ga.; Walter H. Munk, LaJolla, Calif.

[73] Assignee: Georgia Tech Research Corporation, Atlanta, Ga.

[21] Appl. No.: 744,336

[22] Filed: Nov. 7, 1996

[51] Int. Cl.[6] ..... H04R 17/00

[52] U.S. Cl. ..... 367/158; 367/162; 367/176; 367/157; 310/322; 310/334

[58] Field of Search ..... 367/158, 162, 367/176, 157; 310/322, 334, 321

[56] References Cited

U.S. PATENT DOCUMENTS 4,168,485 9/1979 Payton et al. ..... 367/41
4,295,213 10/1981 Mifsud ..... 367/41
4,752,918 6/1988 Boucher et al. ..... 367/158
5,166,907 11/1992 Newnham et al. ..... 367/157
5,316,565 5/1994 Brosow ..... 367/140

*Primary Examiner*—J. Woodrow Eldred
*Attorney, Agent, or Firm*—Needle & Rosenberg, P.C.

[57] ABSTRACT

A state switched acoustic has a stiffness element having a zero potential energy state and a plurality of controllable stiffness states. A mass is coupled to the stiffness element so that the stiffness element and the mass are capable of resonating at a resonant frequency. A system changes the stiffness state of the stiffness element from a first stiffness state to a second stiffness state while the mass is in motion and stiffness element is in a zero potential energy state so as to change the resonant frequency of the transducer. In a method of changing resonant frequency of a mechanical system, a parameter of the system is dynamically changed while the system is in an energy state that will allow changing the resonance parameter without disrupting the resonance of the system.

13 Claims, 12 Drawing Sheets

STATE SWITCHED ACOUSTIC TRANSDUCER

This invention was funded in part by the U.S. Office of Naval Research Contract No. N00014-91-J-4174. The U.S. Government may have certain rights in the invention.

REFERENCE TO A PROVISIONAL APPLICATION

This application for letters patent claims priority under 35 U.S.C. § 119(e) on provisional patent application Ser. No. 60/006,314, filed on Nov. 7, 1995.

BACKGROUND OF THE INVENTION

1. Field of the Invention

The present invention relates to transducers and, more specifically, to transducers having variable resonance.

2. Description of the Prior Art

In order to produce high amplitude low frequency signals, underwater transducers must generate a relatively large volume displacement. Since water exerts a large reaction force back on the transducer, conventional wisdom dictates that such a transducer would have to be a high Q resonant device and thus not be broad band. However, a transducer does not have to be broad band in the conventional sense to meet the requirements of communication and SONAR systems. A transducer that is capable of switching between two discrete frequencies is adequate for many communication applications and one that is capable of switching among several frequencies could produce the chirp signals and codes commonly used in active sonars and oceanographic and geophysical research. Ordinarily, a broad band transducer is needed to accomplish the frequency switching rapidly.

No device or method exists which switches frequency in a transducer without having to add substantial amounts of energy to the system.

SUMMARY OF THE INVENTION

The disadvantages of the prior art are overcome by the present invention which in one aspect is a mechanically resonant system having a plurality of resonant states, having a mass that is capable of resonating in each of the plurality of resonant states a driver for causing the mass to resonate and a system for dynamically changing the resonant state of the system from a first state of the plurality of resonant states to a second state of the plurality of resonant states.

In another aspect, the invention is a variable frequency transducer that has a stiffness element having a zero potential energy state and a plurality of controllable stiffness states. A mass is coupled to the stiffness element so that the stiffness element and the mass are capable of resonating at a resonant frequency. A system changes the stiffness state of the stiffness element from a first stiffness state to a second stiffness state while the mass is in motion and the resonant member is in the zero potential energy state so as to change the resonant frequency of the transducer.

The resonant member could include an active spring, such as a piezoelectric ceramic that is longitudinally or radially polarized.

In another aspect, the invention is a transducer having a variable resonant frequency, including a head mass and a tail mass that is spaced apart from the head mass. An electrically controlled driver causes at least one of the head mass and the tail mass to move in resonant motion. A piezoelectric ceramic active spring has a plurality of stiffness states, wherein the resonant frequency of the transducer is a function of the head mass, the tail mass and the stiffness state of the active spring. A system controls the stiffness of the active spring and changes the stiffness of the active spring when the active spring is in a zero potential energy state, thereby changing the resonant frequency of the transducer.

Yet another aspect of the invention is a method of changing resonant frequency of a mechanical system wherein a resonance parameter of the system is dynamically changed while the system is in an energy state that will allow changing the resonance parameter without disrupting the resonance of the system.

The system may include a stiffness element, having a stiffness, coupled to a resonating mass member, having a mass, and wherein the parameter could include the stiffness of the stiffness element or the mass of the mass member. The energy state could include a state in which the stiffness element has substantially zero potential energy or a state in which the mass has substantially zero kinetic energy.

Thus, it is possible to instantaneously switch frequencies with a high Q resonant system provided that the resonant frequency of the system is altered along with the drive frequency. Moreover, by switching at the proper time, it is possible to accomplish the switching without having to provide additional energy to the system. Such a "state-switched" transducer retains the advantages (high power, high efficiency, and large displacements) of a high Q resonant transducer without the accompanying disadvantages (narrow bandwidth and slow response time).

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

An advantage of the state switched acoustic transducer is that it combines broad band, high power, and low frequency characteristics in an underwater transducer. These characteristics place conflicting requirements upon the source unless state switching is utilized. The state switched transducer is capable of generating a highly-controllable signal for data transmission, communication, and signaling applications. Operation of the transducer at resonance maximizes the transmission distance and provides the most efficient energy usage possible.

Typically, a transducer would be operated in the flat region of its response, at frequencies above resonance with an inherently lower signal level than at resonance. This allows for operation over a wide range of frequencies but at a reduced signal level. The broad band characteristic indicates a need for a low Q or a non-resonant transducer. However, a transducer must be capable of generating large displacements in order to produce a high power signal. It must also be able to counteract the forces imposed by the underwater environment. Thus, it must also be capable of generating large forces. Large displacements coupled with large forces indicate a need for a high Q or resonant transducer. The state switched acoustic transducer takes advantage of its high Q resonance to provide high power levels at low frequencies while achieving effective bandwidth by switching between multiple distinct resonant states.

The state switched transducer's transmitted signal may be switched amongst multiple resonant frequencies with no loss of energy during the switching process. Operation at resonance maximizes the efficiency of the transducer and by switching among multiple resonant frequencies, the transducer's efficiency is maintained at high levels. The result is a signal that may be composed, for example, of one cycle of the first resonant frequency, two cycles of the second resonant frequency, three cycles of the first resonant frequency, one cycle of the third resonant frequency, one cycle of the first resonant frequency, two cycles of the fourth resonant frequency, and one cycle of the third resonant frequency.

DETAILED DESCRIPTION OF THE INVENTION

Figure 1C:
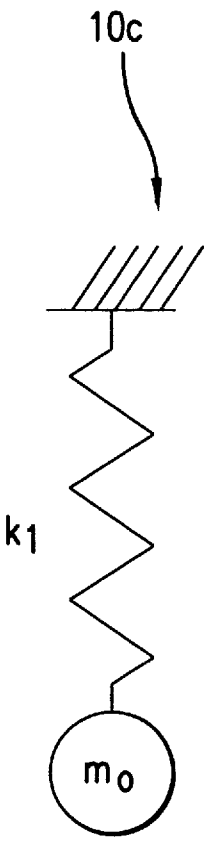
FIG. 1A–1C is a schematic diagram of simple harmonic oscillators for explanation of the state switching concept in accordance with the invention.

A preferred embodiment of the invention is now described in detail. Referring to the drawings, like numbers indicate like parts throughout the views. As used in the description herein and throughout the claims, the following terms take the meanings explicitly associated herein, unless the context clearly dictates otherwise: "a," "an," and "the" include plural reference, "in" includes "in" and "on."

A state switched acoustic source is an acoustic source that has the ability to switch among multiple distinct resonant states, while maintaining resonance throughout the switching process. At any given time, the source has only one fundamental resonance as with any typical source. The distinction of a state switched source is that it has the ability to change its resonance by altering a property of the system. State switching is accomplished by driving the source to resonance and at a predetermined time, switching both the resonant frequency and the driving frequency of the source simultaneously. The resonant and driving frequencies are changed by the control system.

Figure 1B:
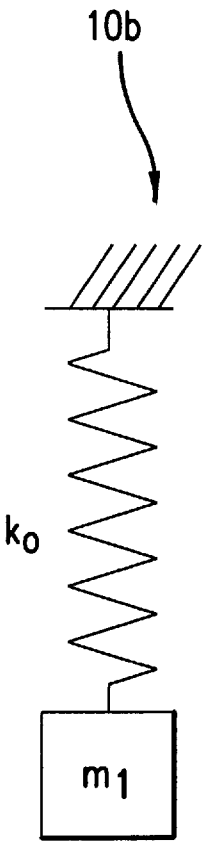
Figure 1A:
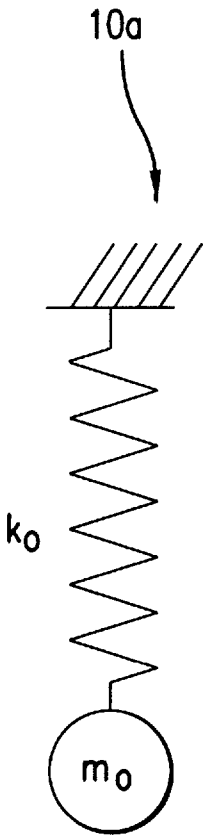

State switching is most apparent upon examination of a simple harmonic oscillator as shown in FIGS. 1A–1C. The mass-spring system 10*a* of FIG. 1A has a resonant frequency, $\omega_0$, as defined by:

$$\omega_o = \sqrt{\frac{k_o}{m_o}}$$

with a spring of stiffness of $k_o$ and a mass of $m_o$. Changing the mass of the first system produces a system 10*b*, shown in FIG. 1B, with a new resonant frequency, $\omega_1$, defined by:

$$\omega_1 = \sqrt{\frac{k_o}{m_1}}$$

where the new mass is represented by $m_1$. A second way to modify the resonance frequency of the original mass-spring system is to change the stiffness of the spring to $k_1$, such that:

$$\omega_1 = \sqrt{\frac{k_1}{m_o}}$$

as shown by the system 10*c* in FIG. 1C. For the purpose of describing the state switching concept, the masses and stiffness of FIGS. 1A–1C have been chosen such that:

$$\omega_1 = \frac{\omega_o}{2}$$

$$k_1 = \frac{k_o}{4}$$

$$m_1 = 4m_o$$

(although any convenient, achievable value for $\omega_1/\omega_0$ could be used in an actual system). This provides for a high frequency, $\omega_0$, which is exactly twice the low frequency, $\omega_1$.

Figure 2A:
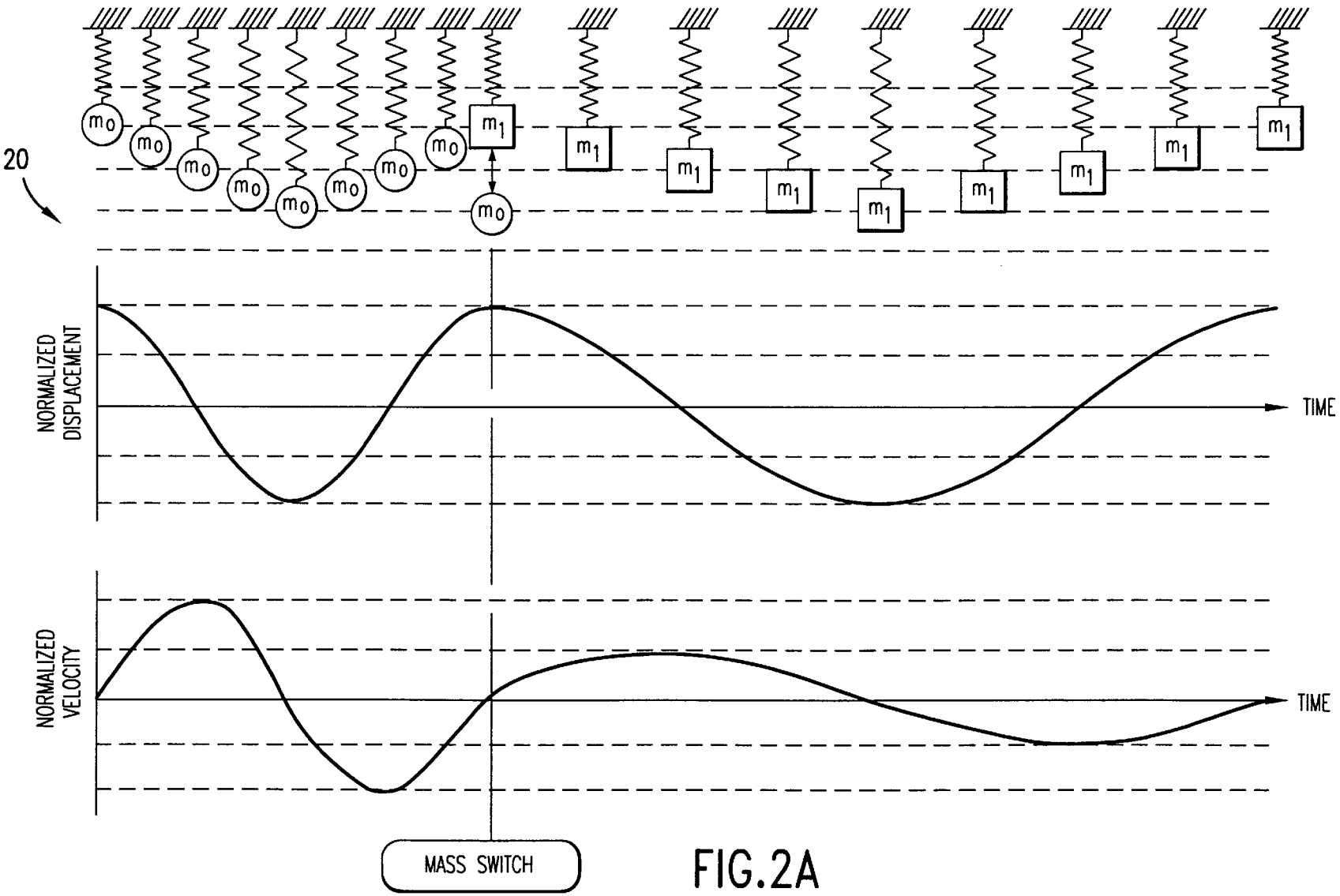
FIG. 2A is a graph showing resonance during mass switching.

In a mass-switching realization of state switching, the simple mass-spring system of FIG. 1A is driven to resonance at its natural frequency, $\omega_0$. At a point of zero velocity, the mass is instantaneously replaced by the second mass, $m_1$, to produce the simple harmonic oscillator shown in FIG. 1B. This effectively changes the resonant frequency of the system to the new value, $\omega_1$. At the same time that the mass is switched, the driving frequency is changed to correspond to the new resonant frequency of the system. The switch and its effect on the system are shown by the graph 20 in FIG. 2A. The switch takes place at a point of zero velocity where the kinetic energy of the system is zero. At this point, all of the system energy is in the spring and the potential energy of the system is a maximum. By changing the mass of the system at a point of zero kinetic energy, the total energy of the system is unchanged by the switching process. Throughout the switch, energy is conserved and no work is done. At a subsequent point of velocity, the mass may be replaced by the original mass, $m_0$, to return the resonant frequency to the original value of $\omega_0$. To maintain resonance when the masses are switched, the drive frequency must also be changed to correspond to the original resonant frequency.

Conservation of energy requires that the displacement amplitude remain constant through the switching process, for a mass-switching realization of state switching, while the velocity amplitude changes according to:

$$\frac{|V_H|}{|V_L|} = \frac{\omega_H}{\omega_L}$$

where $|V_H|$ is the amplitude of the velocity at the high frequency, $\omega_H$, and $|V_L|$ is the amplitude of the velocity at the low frequency, $\omega_L$. Using the values chosen for the oscillators shown in FIG. 1A, the velocity amplitude is reduced by a favor of two when changing from $\omega_0$ to $\omega_1$. This is shown in the displacement and velocity graph 20 of FIG. 2A.

Figure 2B:
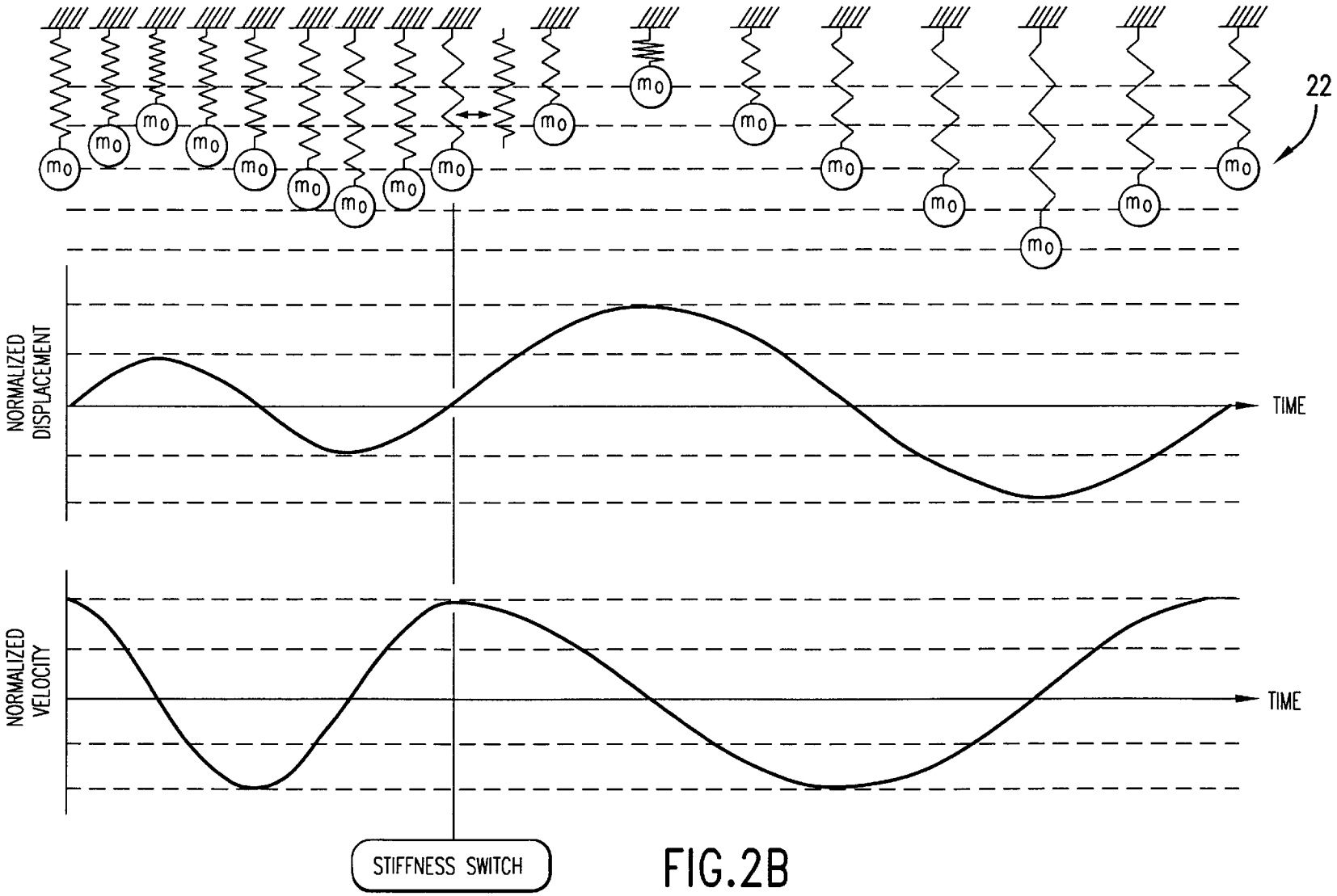
FIG. 2B is a graph showing resonance during stiffness switching.

In a similar manner, the stiffness of the system can be changed to produce a state switched source. Beginning again with the original mass-spring system of FIG. 1A being driven at its fundamental resonance, $\omega_0$, the stiffness of the system is instantaneously changed (e.g., by changing springs) to a different value, $k_1$, at a point of zero displacement to produce the simple harmonic oscillator 10*c* shown in FIG. 1C. At the same time that the stiffness is changed, the drive frequency of the system is changed to correspond to the system's new resonant frequency, $\omega_1$. The effect of the stiffness switch on the system is shown in the graph 22 in FIG. 2B. The zero displacement point corresponds to a zero potential energy state for the system. That is, at this point all of the system energy is in the kinetic energy of the mass. By switching at a zero potential energy state, the total energy of the system is unaffected by the state switching and resonance is maintained. The system can then be state switched back to the first resonant state described above.

In the stiffness-switching realization, energy conservation requires that the displacement amplitude change according to:

$$\frac{|X_H|}{|X_L|} = \frac{\omega_H}{\omega_L}$$

where $|X_H|$ is the displacement amplitude at the high frequency, $\omega_H$, and $|X_L|$ is the displacement amplitude at the low frequency, $\omega_1$. The velocity amplitude remains constant throughout the switch. Using the values chosen for the simple harmonic oscillators of FIGS. 1A–1C, the displacement amplitude doubles when changing from $\omega_0$ to $\omega_L$.

Application of the state switching concept to an acoustic transducer makes operation possible at resonance for maximum efficiency while the operating bandwidth is limited only by the magnitude of the frequency change between the distinct resonant states. By incorporating the state switching concept into a high Q transducer, the advantages of the high Q resonance (large displacements, large forces, and high efficiency) are retained while the slow response time of a high Q resonant source is avoided. State switching provides the means of incorporating high power and broadband operation at low frequencies in an underwater transducer.

Figure 3:
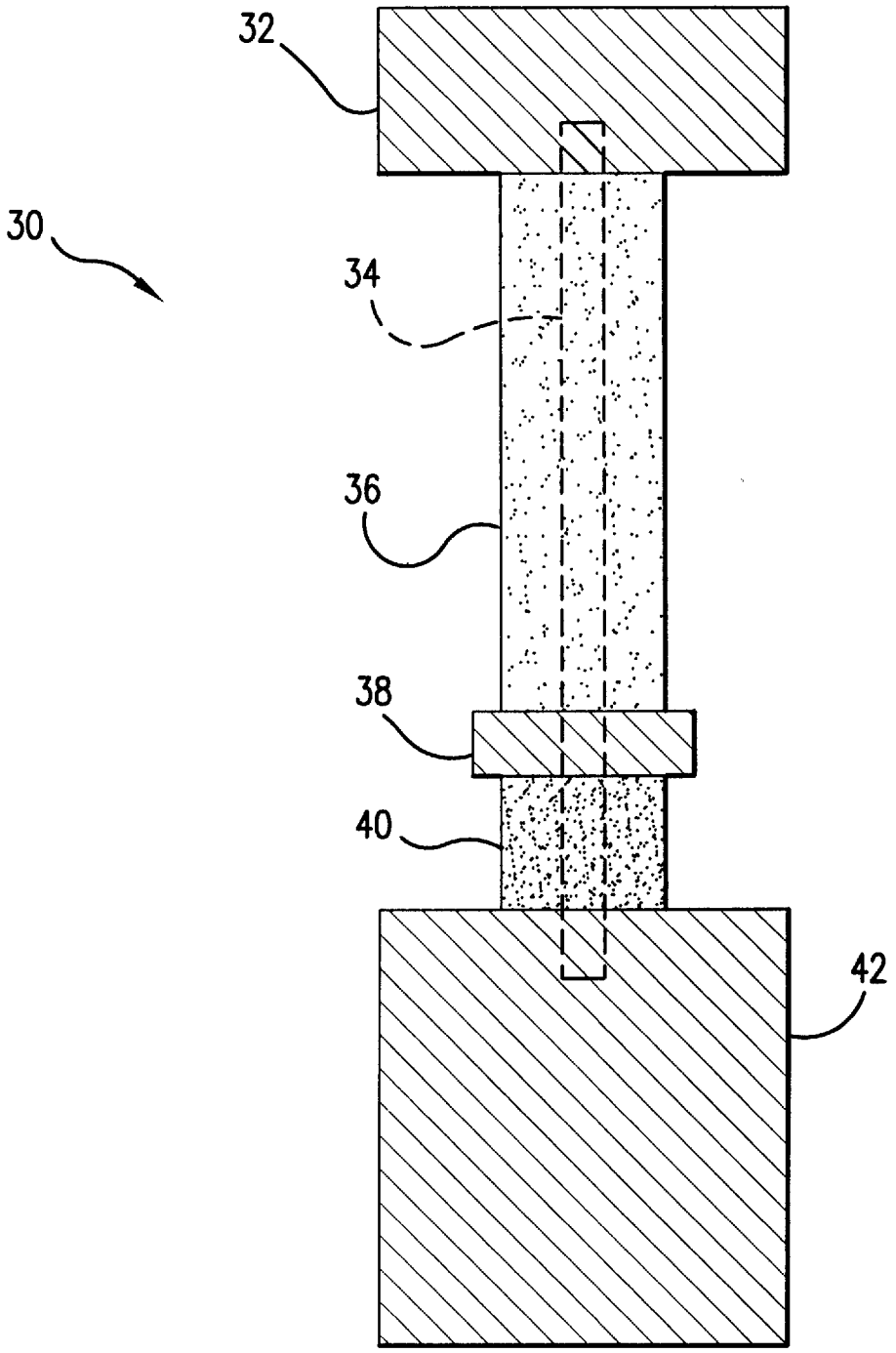
FIG. 3 is a schematic diagram generally showing the invention.

A conceptual design of a state switched acoustic transducer 30 which utilized stiffness switching is shown in FIG. 3. The transducer includes a head mass 32, a tail mass 42, a driver 40 of piezoelectric ceramic, an active spring 36 of piezoelectric ceramic, a tierod 34 to keep the piezoelectric ceramic active spring 36 in compression, and a spacer 38 as an interface between the driver 40 and the active spring 36. The transducer 30 is driven by placing an alternating voltage across the driver 40 at the desired frequency. The resonant state of the state switched acoustic transducer is switched by changing the stiffness of the active spring 36.

The active spring 36 is made from piezoelectric ceramic which allows for control of the active spring's 36 stiffness. The idea is to exploit the change in mechanical properties which occurs in a piezoelectric material when the electric boundary condition is changed from open circuit to short circuit. The difference in the stiffness modules of the piezoelectric ceramic between the open and short circuit cases is given by:

$$\frac{k_{oc}}{k_{sc}} = \frac{1}{1 - k^2_{eff}}$$

where $k_{oc}$ is the open circuit stiffness, $k_{sc}$ is the short circuit stiffness, and $k_{eff}$ is the effective coupling of the piezoelectric ceramic. The frequency ratio for the state switched acoustic transducer 30 is then given by:

$$\frac{f_{oc}}{f_{sc}} = \sqrt{\frac{1}{1 - K^2_{eff}}}$$

where $f_{oc}$ is the open circuit resonant frequency and $f_{sc}$ is the short circuit resonant frequency. The maximum value for $k_{eff}$ is the appropriate coupling coefficient of the piezoelectric ceramic material based upon the ceramic polarization and the direction of motion. The joints in the ceramic stack and the compliance of both the piezoelectric driver and the compression bolt reduce the effective coupling coefficient.

Figure 4A:
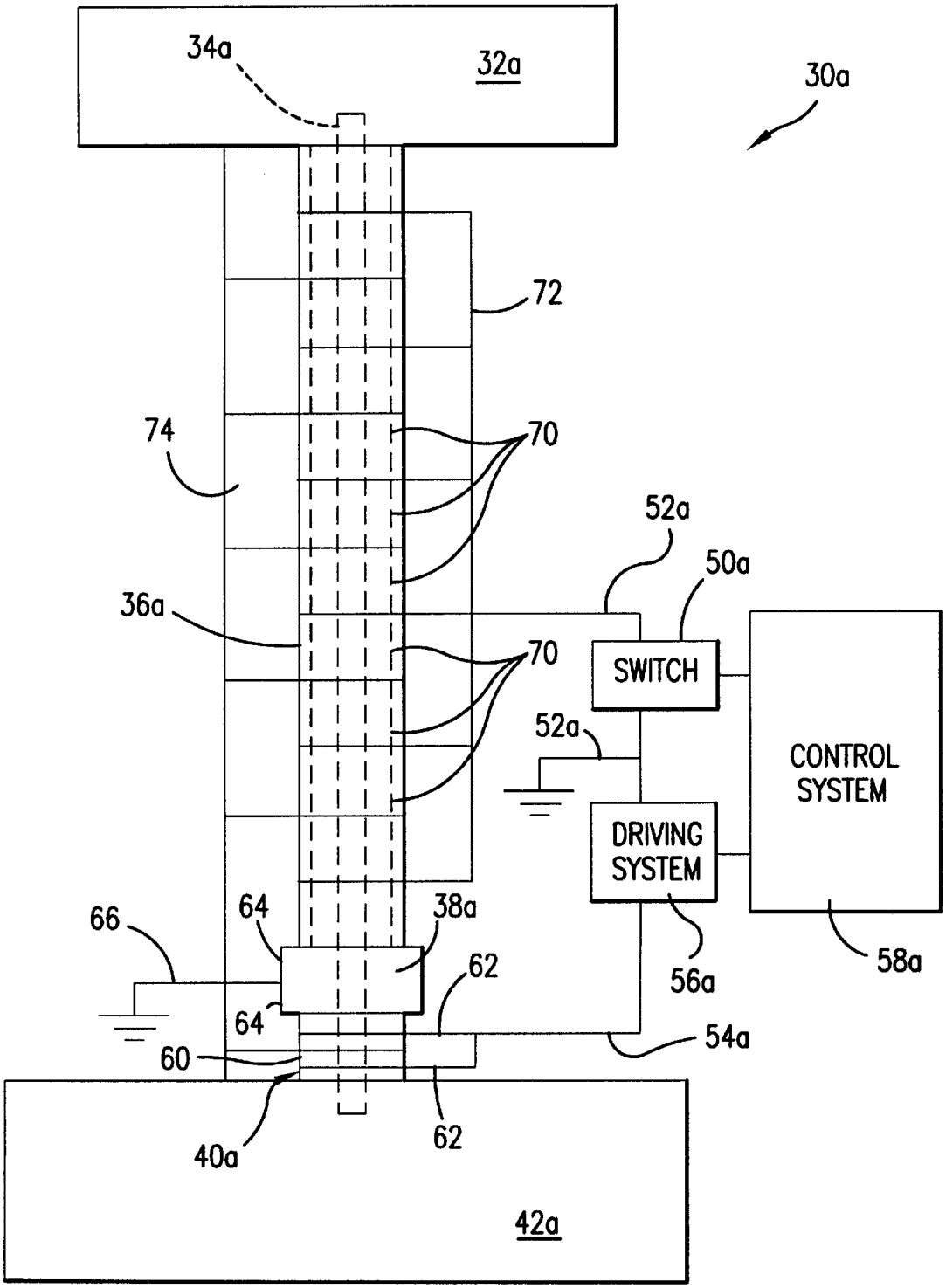
FIG. 4A is a schematic diagram of a longitudinally-polarized active spring embodiment of the invention.
Figure 4B:
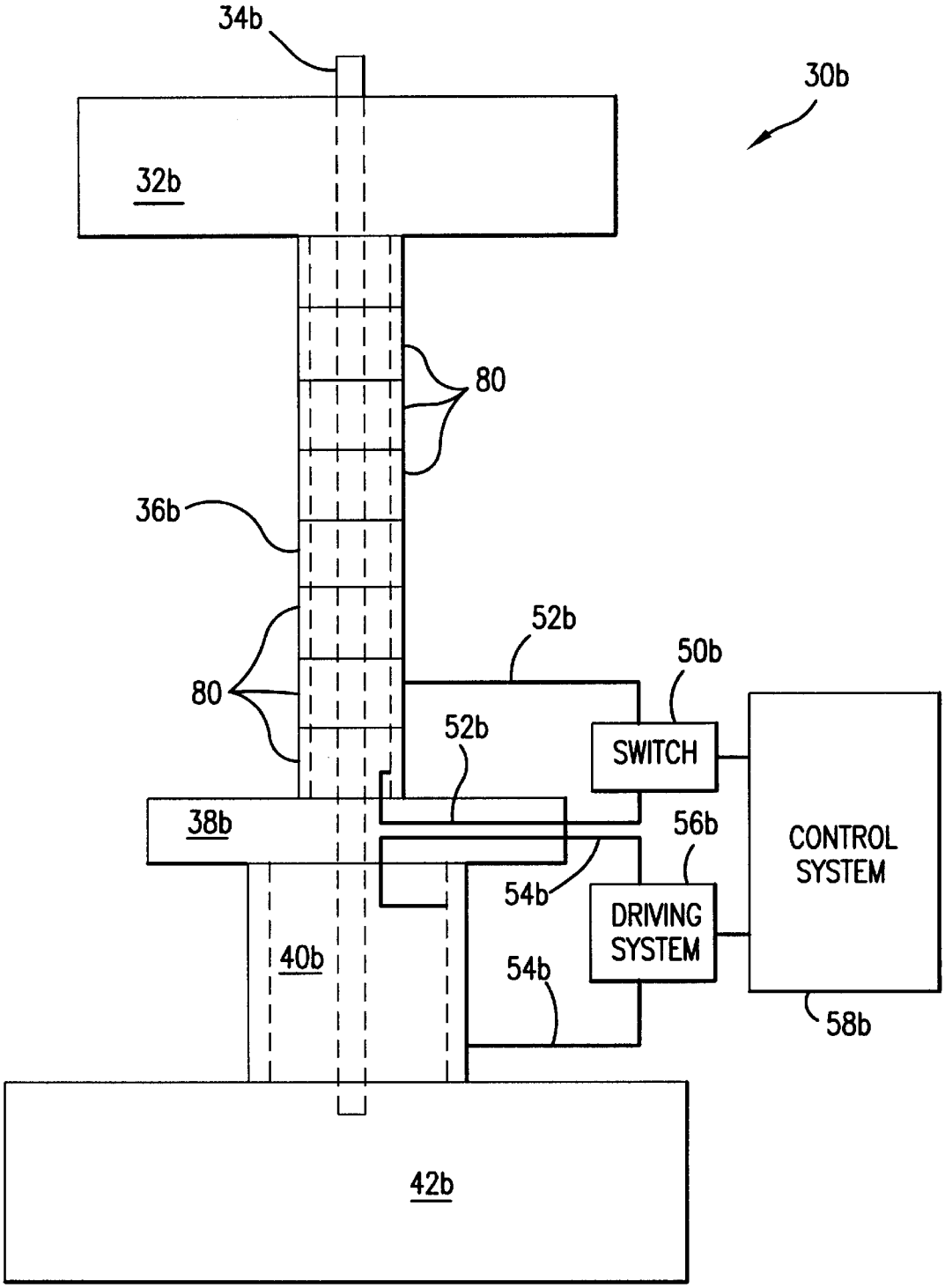
FIG. 4B is a schematic diagram of a radially-polarized active spring embodiment of the invention.

The transducer could comprise an active spring may be made from longitudinally-polarized piezoelectric ceramic as shown in FIG. 4A, or from radially-polarized piezoelectric ceramic as shown in FIG. 4B. Both sources have the same main components: a head mass 32*a,b*, a tail mass 42*a,b*, a driver 40*a,b*, an active spring 36*a,b*, a tierod 34*a,b*, an electronic switch 50*a,b*, electrical leads 52*a,b* for the active spring 36*a,b*, electrical leads 54*a,b* for the driver 40*a,b*, a driving system 56*a,b*, a control system 58*a,b*, and a spacer 38*a,b*.

Referring to FIG. 3, the head mass 32 and the tail mass 42 serve to lower the resonant frequency of the transducer 30 by increasing the effective mass. The motion of the head mass 32 and the tail mass 42 is governed by their relative sizes. For example, with a head mass 32 that is one quarter of the mass of the tail mass 42, the displacement of the head mass 32 will be four times the displacement of the tail mass 42. The spacer 38 acts as an interface between the driver 40 and the active spring 36. The tierod 34 is used to keep the piezoelectric ceramic of the active spring 36 and the driver 40 in compression.

In FIG. 4A, the driver 40*a* is depicted as a stack of thin piezoelectric ceramic disks 60, polarized in the longitudinal direction. The stack as shown comprises two pairs of disks 60 but may be made from any even number of disks 60. Each pair of disks 60 is assembled such that the positive electrodes 62 of the two disks are electrically coupled. The negative electrodes 64 are then connected to the electrical ground 66. Application of a voltage to the common positive electrode 62 then causes expansion of both disks 60 in the pair. The disks 60 have electrodes attached to the top and bottom surfaces during the manufacturing process. A flat metal mesh (not shown) may be included in the joints between the piezoelectric disks 60 to allow for connection of the electrical leads 62, 64 for the driver 40*a*. Each joint is formed of conducting epoxy to ensure a thin, stiffjoint. The active spring 36*a* is a stack of an even number of thin-walled, hollow, piezoelectric cylinders 70 polarized in the longitudinal direction with the same type ofjoints as in the driver 40. Twelve cylinders 70 are shown in the active spring 36*a* shown in FIG. 4A, but it will be appreciated that any even number of piezoelectric ceramic cylinders 70 may be used. The positive electrodes 72 are again joined together and the negative electrodes 74 are connected to the electrical ground 66 as in the driver 40*a* assembly.

FIG. 4B shows a transducer 30*b* using a radially-polarized piezoelectric ceramic rather than longitudinally-polarized piezoelectric ceramic. The driver 40*b* is made of a thin-walled hollow cylinder of piezoelectric ceramic, polarized in the radial direction, with electrodes 54*b* on the inner and outer surfaces. The electrodes 54*b* are attached during the manufacturing process. The outer electrode 54*b* is connected to an electrical ground. The active spring 36*b* is a stack of thin-walled, hollow cylinders 80 of piezoelectric ceramic, polarized in the radial direction, with electrodes 52*b* on the inner and outer surfaces. All of the joints in the source shown in FIG. 4B use a non-conducting epoxy. No thin metal mesh is used in the joints of the radially-polarized ceramic stacks as it would cause the electrodes of the ceramic to be short circuited.

Selection of the piezoelectric material, the polarization direction and the piezoelectric ceramic dimensions determine the operating capabilities of the state switched acoustic transducer. The dimensions of the piezoelectric ceramic used in the active spring may be varied to allow for a desired set of distinct resonant frequencies. By short circuiting only a portion of the active spring, the resonant frequency can be adjusted to a value between the upper limit (when all of the segments are open circuited) and the lower limit (when all of the segments are short circuited).

The state switched acoustic transducers of FIGS. 4A and 4B include a control system 58*a,b* with a driving system 56*a,b* and an electronic switch 50*a,b*. The driving system 56*a,b* provides the excitation voltage at the desired frequency for the driver 40*a,b* stack. The electronic switch 50*a,b* controls the electrical connections of the active spring 36*a,b* stack. The control system 58*a,b* provides the driving system 56*a,b* with the appropriate frequency and driving voltage. The control system 58*a,b* also controls the switches 50*a,b* for the active spring 36*a,b*. For simplicity, the active spring 36*a,b* is shown with only one switch 50*a,b*. However, a separate switch could be used for each segment to allow for greater control of the transducer's resonant states.

In one embodiment, the head mass is a steel disk having an outer diameter of 4" and a length of 1". The tail mass is a steel cylinder having an diameter of 4" and length of 4". The driver is made of four thin discs of piezoelectric ceramic having an outer diameter of 0.75", an inner diameter of 0.2", a thickness of 0.1" and a total length of 0.4". The active spring is made of 20 thin-walled, hollow cylinders of piezoelectric ceramic with an outer diameter of 0.75", inner diameter of 0.584", a length of 0.3" and a total length of 6". All of the piezoelectric ceramic is polarized in the longitudinal direction. The tierod is a 6–32 threaded steel rod that runs through the center of the active spring/driver assembly to keep the ceramic in compression. The electrodes are made of a flat metal wire mesh with conducting epoxy to ensure a thin joint between adjacent piezoelectric cylinders. The electrical leads are attached to the electrodes of the driver and the active spring. The spacer has an outer diameter of 1", an inner diameter of 0.2660" and a length of 0.5", and is provided as an interface between the active spring and the driver.

Figure 5A:
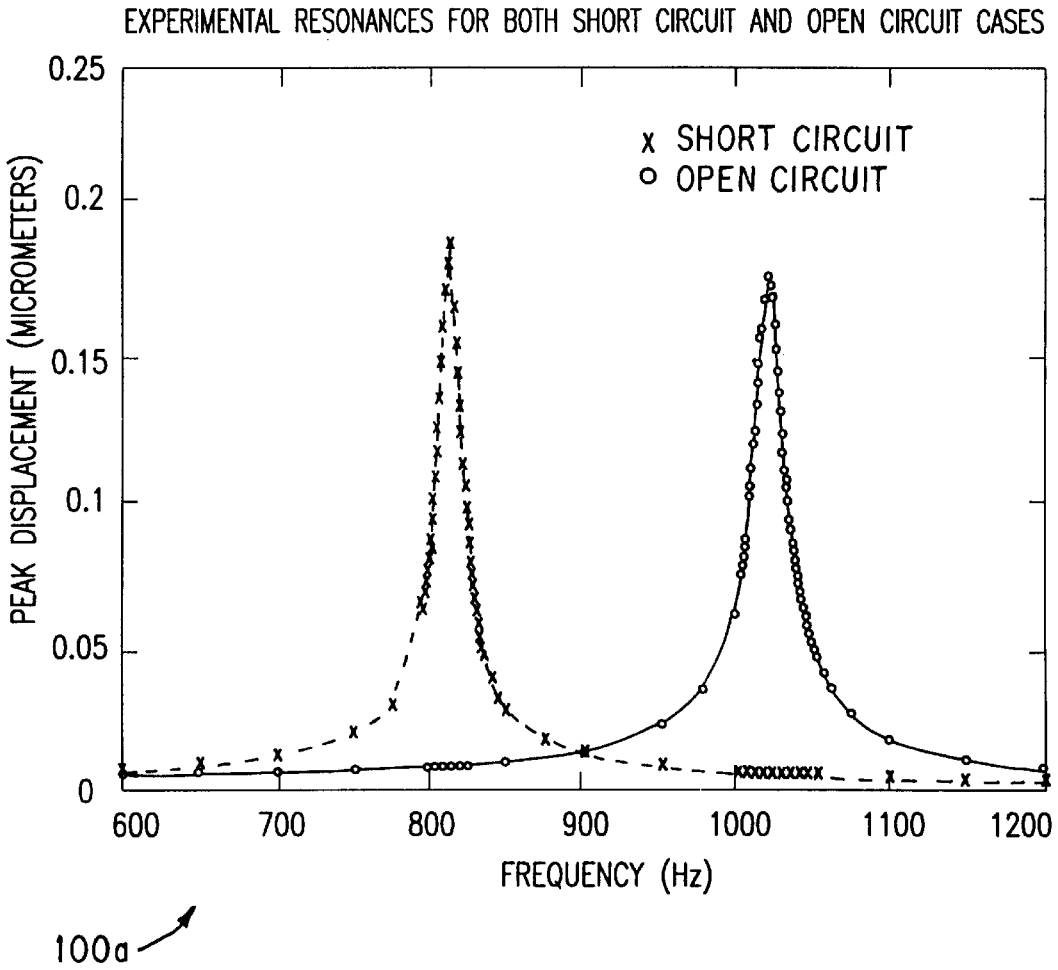
FIG. 5A is a graph showing resonance data for active spring in accordance with one embodiment of the invention.

In this embodiment, operation in air yielded the resonance curves shown in FIG. 5A for the active spring in both the open and short circuit states. The change in resonance was 207 Hz between the open circuit resonance of 1019 Hz and the short circuit resonance of 812 Hz. The Q of the state switched acoustic transducer is quite high in air (open circuit Q=35.0, short circuit Q=38.1) as seen in FIG. 5A.

Figure 5B:
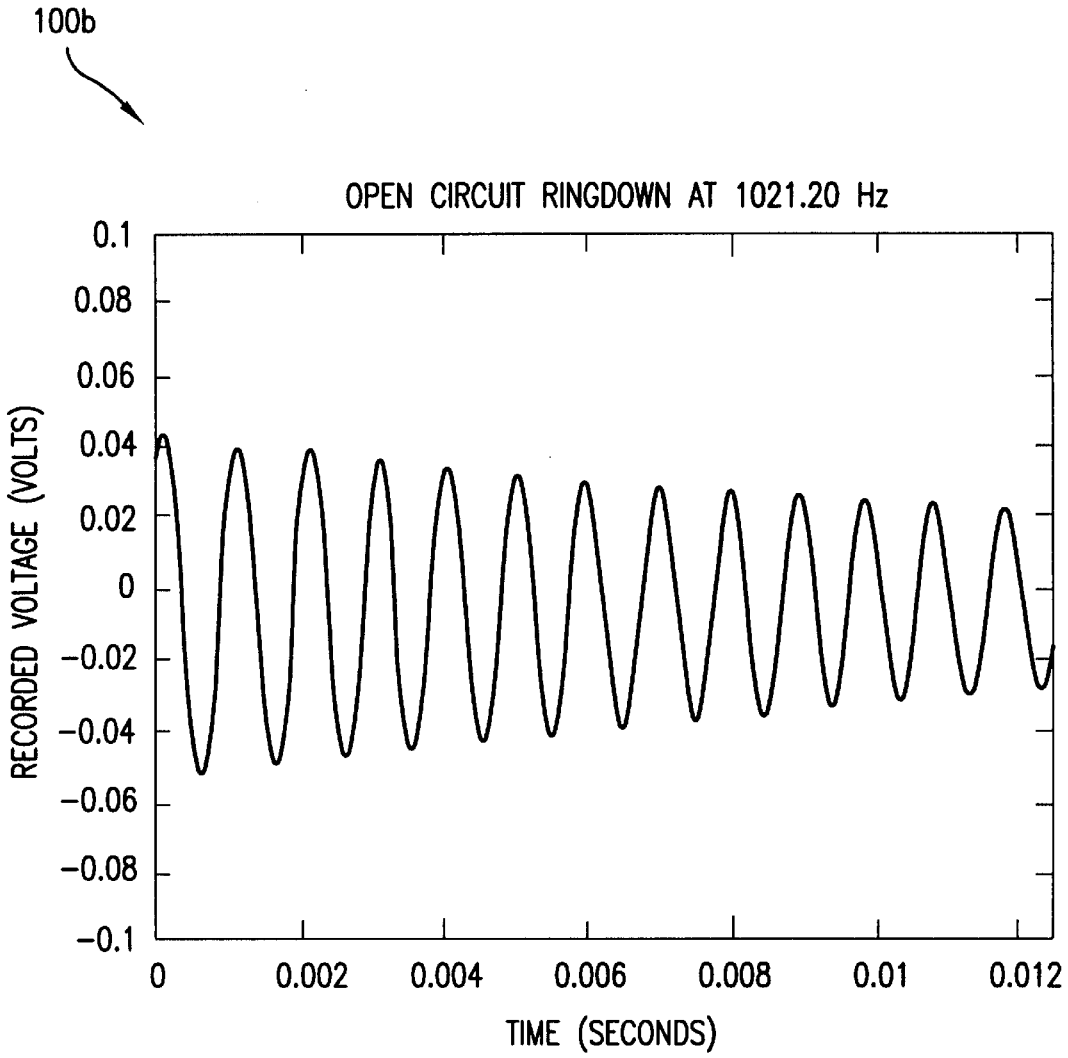
FIG. 5B is a graph showing open circuit ringdown in accordance with one embodiment of the invention.
Figure 5C:
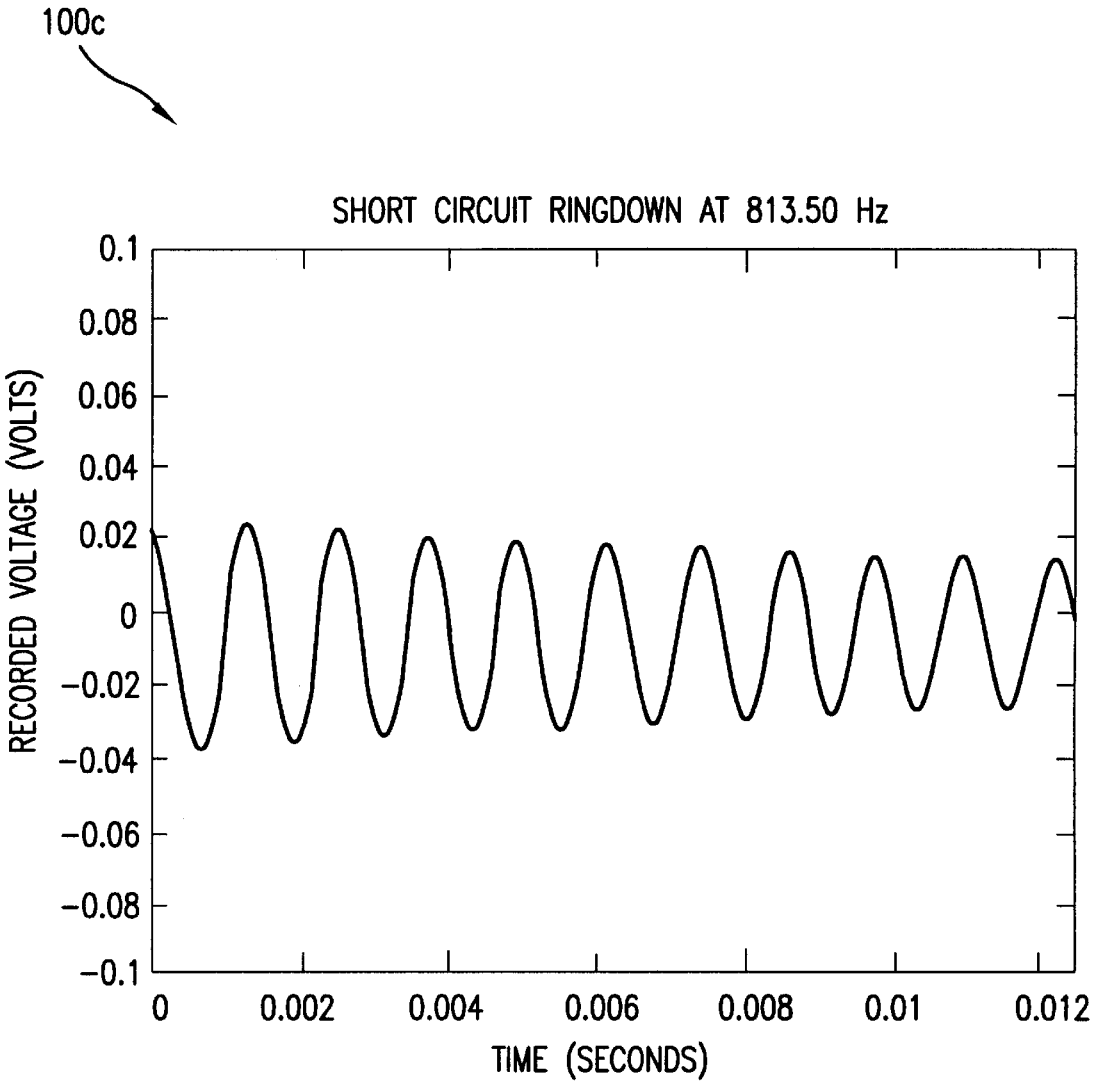
FIG. 5C is a graph showing short circuit ringdown in accordance with one embodiment of the invention.
Figure 5D:
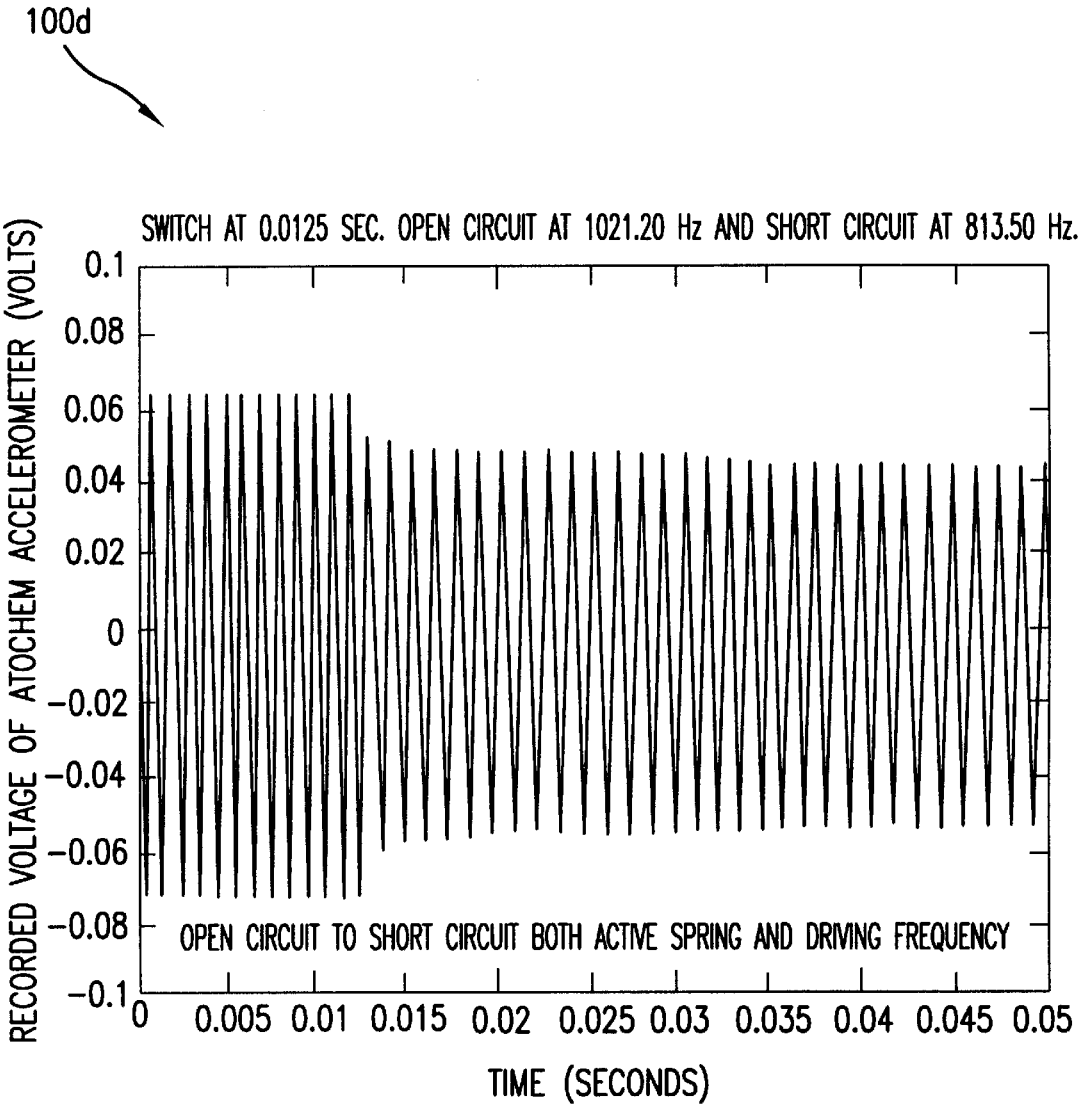
FIG. 5D is a graph showing open circuit to short circuit, state switching in accordance with one embodiment of the invention.
Figure 5E:
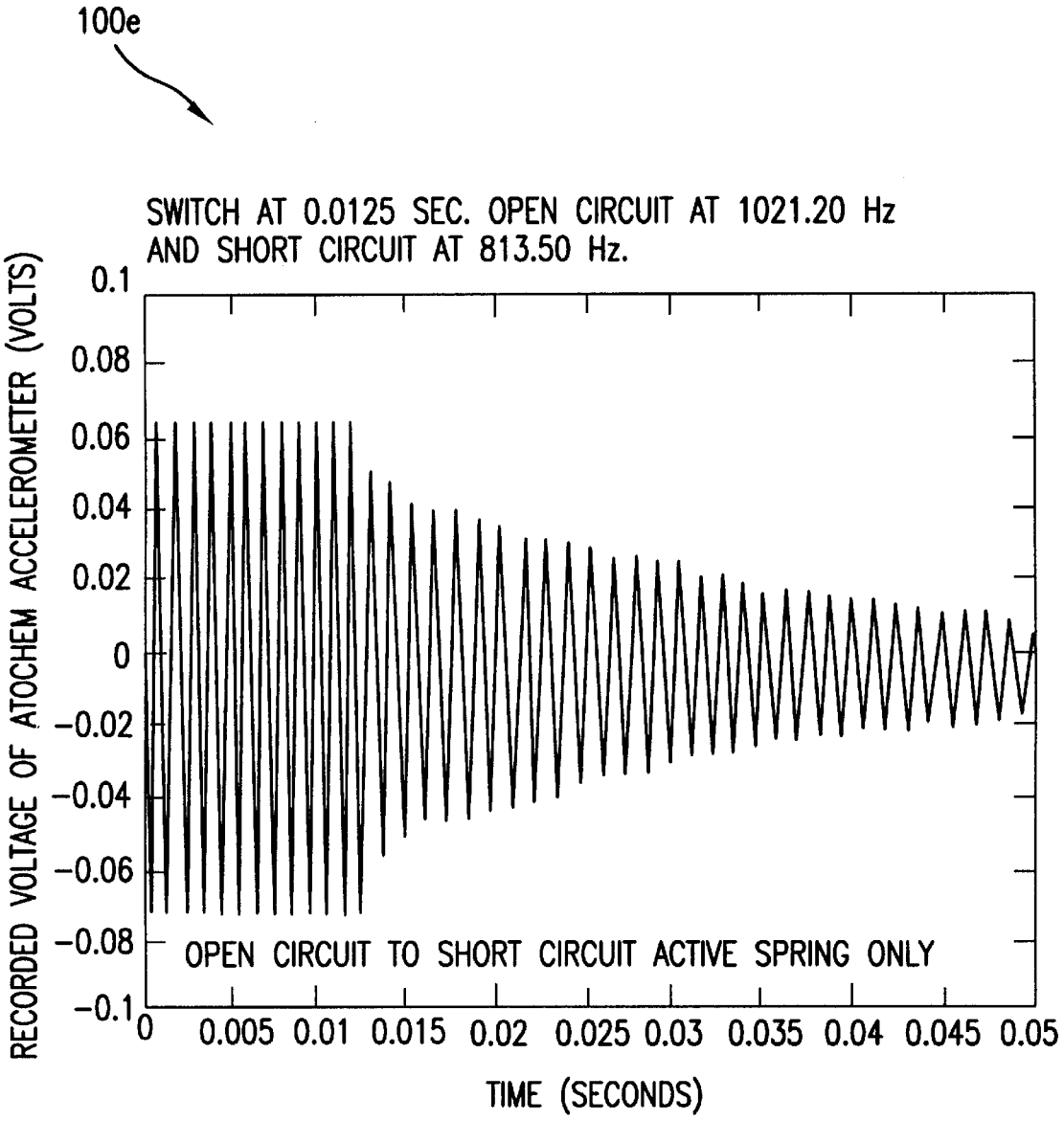
FIG. 5E is a graph showing open circuit to short circuit, switching of the driving frequency in accordance with one embodiment of the invention.
Figure 5F:
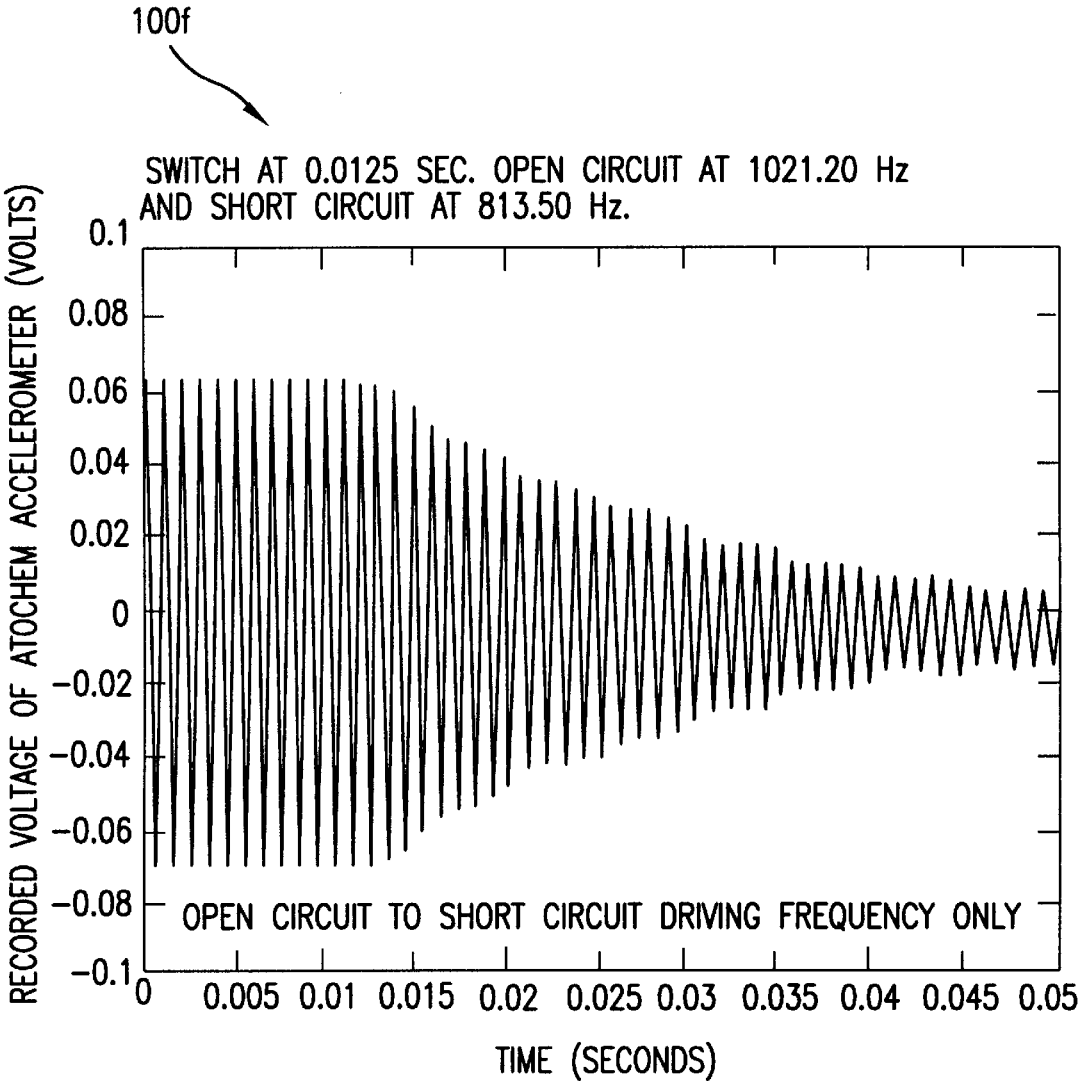
FIG. 5F is a graph showing open circuit to short circuit, switching driving frequency only in accordance with one embodiment of the invention.

The state switched acoustic transducer is operated by determining the damped natural frequencies for each condition of the active spring (short circuit and open circuit), shown in FIGS. 5B–C. The source is then driven to resonance at the open circuit damped natural frequency. This is shown in FIG. 5D. The switch occurs at a zero displacement point for conservation of energy. This results in a transmitted signal which changes from the open circuit damped natural frequency to the short circuit damped natural frequency while maintaining resonant conditions throughout the switching process. Transient effects result from switching only the active spring, shown in FIG. 5E, and switching only the driving frequency, shown in FIG. 5F, from open circuit to short circuit.

The data 100*a–f* shown in FIGS. 5A–F are intended to demonstrate the state switching concept in the most straightforward fashion by switching between the highest possible resonant frequency and the lowest possible resonant frequency. The state switched acoustic transducer can operate at multiple distinct resonant frequencies since the active spring has been made from several short segments of piezoelectric ceramic. By varying the number of piezoelectric cylinders which are short circuited, the resonant frequency can be changed. The upper limit on the frequency range corresponds to the open circuit damped natural frequency. The lower limit on the frequency range corresponds to the short circuit damped natural frequency.

The above described embodiments are given as illustrative examples only. It will be readily appreciated that many deviations may be made from the specific embodiments disclosed in this specification without departing from the invention. Accordingly, the scope of the invention is to be determined by the claims below rather than being limited to the specifically described embodiments above.

What is claimed is:

1. A variable frequency transducer, comprising:

a. a stiffness element having a plurality of controllable stiffness states, the stiffness element including at least one piezoelectric member electrically coupled to a first electrode and a spaced-apart second electrode, the stiffness element being in a first stiffness state when the first electrode is short circuited with respect to the second electrode and being in a second stiffness state when the first electrode and the second electrode are open circuited with respect to each other;

b. a mass coupled to the stiffness element so that the stiffness element and the mass are capable of resonating at a resonant frequency;

c. a circuit that selectively short circuits the first electrode to the second electrode to cause the stiffness element to be in the first stiffness state and open circuits the first electrode from the second electrode to cause the stiffness element to be in the second stiffness state; and d. means for causing the stiffness element and the mass to vibrate at resonance.

2. The transduce of claim 1, wherein the stiffness element comprises a plurality of piezoelectric members, thereby allowing the stiffness element to have a plurality of stiffness states.

3. The transduce of claim 2, wherein each piezoelectric member comprises a piezoelectric ceramic.

4. The tranducer of claim 3, wherein the piezoelectric ceramic is longitudinally polarized.

5. The tranducer of claim 3, wherein the piezoelectric ceramic is radially polarized.

6. A transducer having a variable resonant frequency, comprising:

a. a head mass;

b. a tail mass spaced apart from the head mass;

c. an electrically controlled driver for causing at least one of the head mass and the tail mass to move in resonant motion;

d. a piezoelectric ceramic active spring including a plurality of piezoelectric members, each electrically coupled to a first electrode and a spaced-apart second electrode, each piezoelectric member being in a first stiffness state when the first electrode is short circuited with respect to the second electrode and being in a second stiffness state when the first electrode and the second electrode are open circuited with respect to each other, so that the active spring has a plurality of stiffness states, wherein the resonant frequency of the transducer is a function of the head mass, the tail mass and the stiffness state of the active spring;

e. a circuit that selectively short circuits the first electrode to the second electrode of at least one selected piezoelectric member so as to cause the selected piezoelectric member to be in the first stiffness state and open circuits the first electrode from the second electrode to cause the selected piezoelectric member element to be in the second stiffness state, whereby a combination of the piezoelectric members in the first stiffness state and in the second stiffness state causes the active spring to be in one of the plurality of stiffness states.

7. The transducer of claim 6, wherein each piezoelectric member comprises a longitudinally polarized piezoelectric ceramic.

8. The transduce of claim 6, wherein each piezoelectric member comprises a radially polarized piezoelectric ceramic.

9. A mechanical resonator, comprising:

a. a stiffness element having a plurality of controllable stiffness states, the stiffness element including at least one piezoelectric member electrically coupled to a first electrode and a spaced-apart second electrode, the stiffness element being in a first stiffness state when the first electrode is short circuited with respect to the second electrode and being in a second stiffness state when the first electrode and the second electrode are open circuited with respect to each other;

b. a mass coupled to the stiffness element so that the stiffness element and the mass are capable of resonating at a resonant frequency; and c. a circuit that selectively short circuits the first electrode to the second electrode to cause the stiffness element to be in the first stiffness state and open circuits the first electrode from the second electrode to cause the stiffness element to be in the second stiffness state.

10. The mechanical resonator of claim 9, wherein the stiffness element comprises a plurality of piezoelectric members, thereby allowing the stiffness element to have a plurality of stiffness states.

11. The mechanical resonator of claim 10, wherein each piezoelectric member comprises a piezoelectric ceramic.

12. The mechanical resonator of claim 11, wherein the piezoelectric ceramic is longitudinally polarized.

13. The mechanical resonator of claim 11, wherein the piezoelectric ceramic is radially polarized.

* * * * *